US008604718B2

(12) United States Patent
Snijder

(10) Patent No.: US 8,604,718 B2
(45) Date of Patent: Dec. 10, 2013

(54) AUTO-ADDRESSING METHOD FOR A TILED LIGHTING SYSTEM

(75) Inventor: Pieter Jacob Snijder, Valkenswaard (NL)

(73) Assignee: Koninklijke Philips N.V., Eindhoven (NL)

( * ) Notice: Subject to any disclaimer, the term of this patent is extended or adjusted under 35 U.S.C. 154(b) by 101 days.

(21) Appl. No.: 13/375,008

(22) PCT Filed: May 25, 2010

(86) PCT No.: PCT/IB2010/052297

§ 371 (c)(1), (2), (4) Date: Nov. 29, 2011

(87) PCT Pub. No.: WO2010/136956

PCT Pub. Date: Dec. 2, 2010

(65) Prior Publication Data

US 2012/0074872 A1 Mar. 29, 2012

(30) Foreign Application Priority Data

May 29, 2009 (EP) ..... 09161553

(51) Int. Cl.
*H05B 37/02* (2006.01)

(52) U.S. Cl.
USPC ..... 315/312; 315/291

(58) Field of Classification Search
None
See application file for complete search history.

(56) References Cited

U.S. PATENT DOCUMENTS 7,307,542 B1 * 12/2007 Chandler et al. ..... 340/9.16
2008/0309259 A1 12/2008 Snijder et al.
2010/0244700 A1 * 9/2010 Chong et al. ..... 315/113

FOREIGN PATENT DOCUMENTS

| | | | |
|---|---|---|---|
| DE | 19540146 | A1 | 5/1996 |
| DE | 102004043197 | A1 | 3/2006 |
| WO | 2006129272 | A2 | 12/2006 |
| WO | 2007063487 | A1 | 6/2007 |
| WO | 2007072319 | A1 | 6/2007 |
| WO | 2008035282 | A1 | 3/2008 |

* cited by examiner

*Primary Examiner* — Crystal L Hammond
(74) *Attorney, Agent, or Firm* — Mark L. Beloborodov

(57) ABSTRACT

This invention relates to a method of controlling a lighting system (1) which has a plurality of polygonal lighting modules (3) arranged as an array, and a controlling device (7) connected to one of the lighting modules. The lighting modules are arbitrarily arrangeable by each lighting module being able to communicate with neighboring lighting modules via communication units (11) arranged at all sides of the lighting module. In an upstart mode each lighting module performs a configuration procedure, which includes: —receiving address data and lighting orientation data from a neighboring lighting module, wherein the address data comprises several address elements, which are related to a relative position of the neighboring lighting module within the lighting system; —aligning its own lighting orientation with the lighting orientation of the neighboring lighting module from which it receives address data and lighting orientation data; and —determining its own address by one of incrementing and decrementing at least one of the address elements depending on the lighting module's position relative to the neighboring lighting element, and according to a predetermined addressing plan. The lighting module which is connected with the controlling device receives initial address data and lighting orientation data from the controlling device.

8 Claims, 4 Drawing Sheets

AUTO-ADDRESSING METHOD FOR A TILED LIGHTING SYSTEM

FIELD OF THE INVENTION

The present invention relates to a method for controlling a modular lighting system, which is built-up from polygonal lighting modules, and to such a system.

BACKGROUND OF THE INVENTION

Modular lighting refers to modules that can be assembled in order to obtain large lighting devices of various sizes and shapes. Each lighting module has several light elements, e.g. RGB LEDs. In addition to the flexibility in adapting the size and shape of such modular lighting applications, e.g. to the available space where the modular lighting application is to be installed or due to other reasons, such modular lighting applications may be used to visualize lighting patterns, such as still or moving images or light effects, on a screen that may have a size and a shape that in general deviates from standard rectangular liquid crystal display (LCD) devices. Particularly two-dimensional lighting modules are typically referred to as lighting tiles, or simply tiles. Such a lighting module may have various polygonal shapes, such as for example a square, triangle or pentagon shape. The lighting modules are not limited to two-dimensional shapes but may have a three-dimensional shape, such as a cube or a pyramid.

WO 2007/063487 discloses a prior art method for controlling a lighting system. The lighting system is built up from a plurality of lighting modules, which are interconnectable to form an array of a desired shape. The system includes a controlling device that is connected to one of the lighting modules in an array. The controlling device provides the array with lighting data, and when the lighting modules are correctly addressed the array displays a desired lighting pattern, such as an image, video, light effect or the like, on basis of the lighting data. Such a lighting system can be used in many different applications, but is often mounted on a wall, a ceiling, or a free standing holder.

It is desired that the lighting system is easy to mount and start to use. This is the case with the system disclosed in WO 2007/063487. The lighting modules are arbitrarily interconnectable by mechanical as well as electrical connections, such as communication units, arranged at their sides. This freedom of connection, however, raises demands on how to communicate lighting data throughout the array of lighting modules such that each module receives the correct data as well as displays the data correctly. According to WO 2007/063487 there is performed a learning procedure for defining a lighting module arrangement and a communication network for communication between the controlling device and the lighting modules. The controlling device sends a token to the connected lighting module. The token is then forwarded from module to module, while ensuring that all lighting modules are visited by the token. Concurrently, geometric information about how the lighting modules are arranged in relation to each other is obtained and reported back to the controlling device. Thereby information about the structure is acquired.

Further, as regards the addressing, initially the lighting modules have no address. The lighting modules are each assigned an address when the token first arrives there. After each assignment the address is updated, and the updated address is forwarded with the token to next module, to ensure that the same address is not provided to two different modules.

This method of gaining knowledge about the structure of the array and providing the modules with individual addresses is very flexible and accurate, but it is rather complex and requires a rather competent controlling device. For some applications a more simple solution would have been sufficient.

SUMMARY OF THE INVENTION

It is an object of the present invention to provide an alternative solution of lighting system control.

This object is achieved by a method of controlling a lighting system according to the present invention as defined in claim 1, and by a lighting system according to claim 8. Due to the addressing procedure being local and generating relative addresses based on the position of the lighting module in the array, and a predetermined addressing plan, no feedback to the controlling device is necessary. It should be noted that the incrementation and decrementation mentioned in the claims as well as below in the description, are not limited to numbers, but are generally defining movement up or down in a series of address elements.

In accordance with an embodiment of the method, the configuration procedure is performed for all lighting modules of the lighting system at an initial startup as well as for a single lighting module when it is being added to the lighting system while it is in operation. This embodiment has the advantage that it is simple to add a lighting module. Since the added lighting module at startup is assigned a relative address by means of address data received from a neighboring lighting module according to the predetermined model of addressing there is no need for communication between the new lighting module and the controlling unit, but the address generation is automized.

In accordance with an embodiment of the method it comprises providing the lighting system with lighting data arranged to generate a lighting pattern by means of the lighting modules, wherein the lighting pattern has a predetermined size. This embodiment contributes with a simplicity, since the controlling device does not have to know or find out the actual size and shape of the array.

In accordance with an embodiment of the method, the address elements comprise a column element and a row element, thereby providing for a simple addressing plan of row/column denotation and incrementation/decrementation.

In accordance with an embodiment of the method the lighting orientation data comprises an individual side identification for each side of a lighting module, the rotational order of side identifications being the same for all lighting modules, wherein said step of aligning comprises setting the lighting orientation according to a unique predetermined combination of side identifications. Since the rotational order of side identifications is common to all lighting modules, it is easy to determine the allowable combinations of neighboring side identifications, and also to adjust the lighting orientation of a lighting module if the detected combination is not allowed.

Corresponding embodiments of the lighting system according to this invention exhibit similar advantages.

It is noted that the invention relates to all possible combinations of features recited in the claims.

BRIEF DESCRIPTION OF THE DRAWINGS

This and other aspects of the present invention will now be described in more detail, with reference to the appended drawings showing a currently preferred embodiment of the invention.

DETAILED DESCRIPTION

An advantage of the lighting system according to the present invention is that when mounting the lighting modules, or tiles, they will not have to be placed with a predetermined rotational orientation. Conventionally, the lighting modules have been provided with a "this-side-up" sign at a rear side thereof. From a user-friendliness point of view the demand to have all tiles rotated properly is felt as cumbersome. This would imply that users have to obey the sign at the back of the lighting module before adding the lighting module to the array. By omitting such a sign, lighting modules may become incorrectly oriented. However, here as well as in the system disclosed in WO 2007/063487 as described above, the lighting modules are allowed to be arbitrarily rotated when mounted. Orientation and addressing methods according to the invention see to it that the lighting pattern is correctly displayed in the end anyhow as will be explained below. Here we arrive at the point where the lighting module's intelligence comes into play. The alignment problem has been solved in a 'plug & play' fashion, i.e. the alignment problem is resolved by the system in a way unnoticeable to the user.

Figure 1:
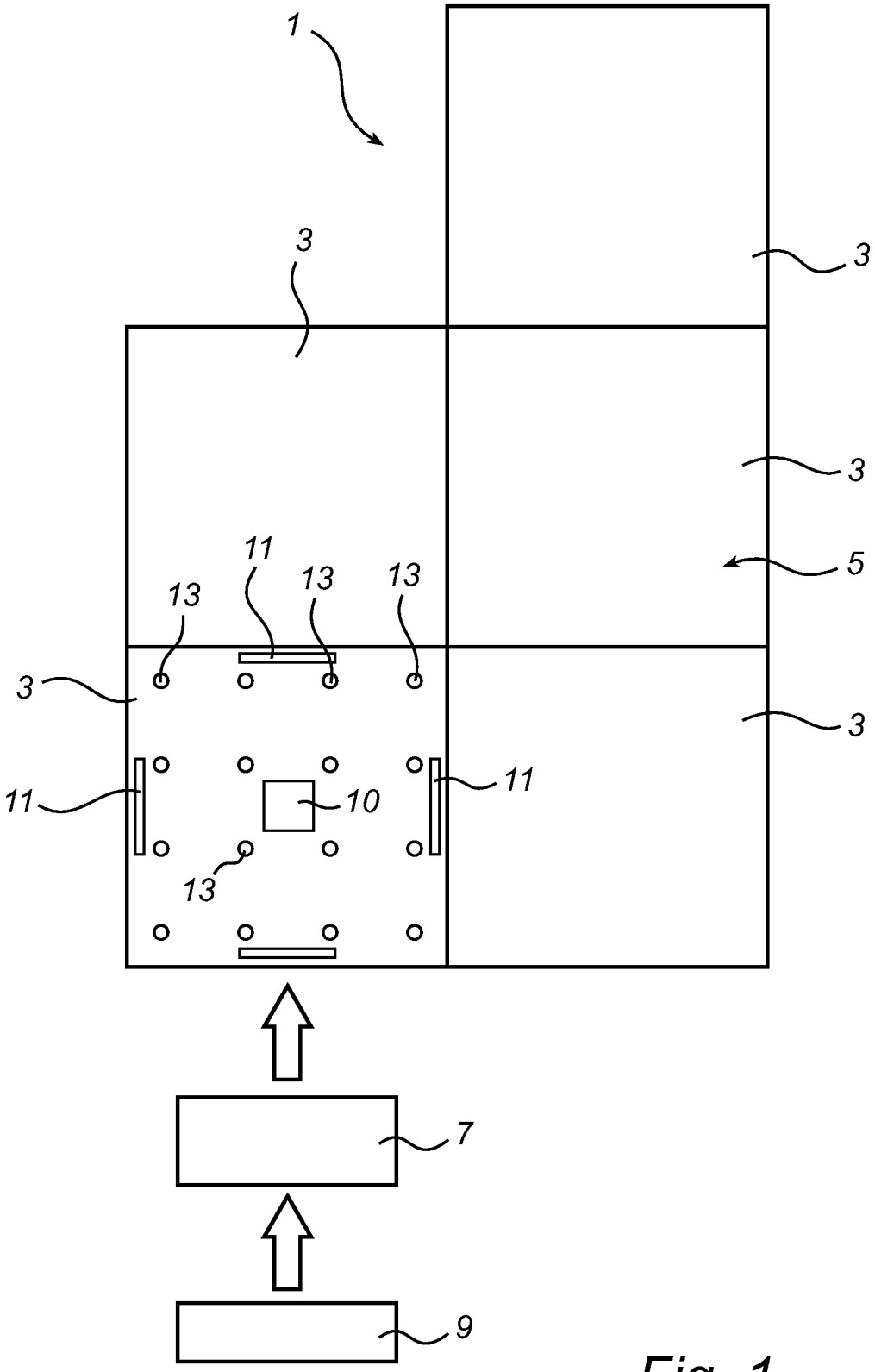
FIG. 1 illustrates an embodiment of the lighting system and method according to the present invention.

FIG. 1 shows an example of a lighting system 1 comprising several lighting modules 3, which have been mounted to form an array 5. The shape of the array is merely an illustrative example showing that in principle any desired shape, which is obtainable considering the shape of the lighting modules 3, can be built. In addition to the lighting modules 3 the lighting system 1 comprises a controlling device 7, which has been connected to one of the lighting modules 3, and a lighting pattern source 9, which has been connected to the controlling device 7. The lighting pattern is provided to the controlling device, which in turn applies it to the connected lighting module 3, which will be called first lighting module in the following. Each lighting module 3 has a communication unit 11 at each side thereof. Each lighting module 3 comprises a plurality of lighting elements 13, such as RGB LEDs. For example, each lighting module 3 may have 16 lighting elements 13 symmetrically spread across the lighting module in four rows and four columns. Further, each lighting module 3 has a module controller 10, which controls the operation of the lighting module 3.

When two neighboring lighting modules are interconnected, the communication units of their respective adjacent sides are interconnected for data transferring. Generally, when a lighting module 3 receives lighting data via one communication unit 11, it uses the data thereof that is aimed for it and retransmits the lighting data at all other sides to any other neighboring lighting module 3. In some applications, while retransmitting the lighting data, the lighting module 3 may add or modify some data in dependence of its own state. In order to handle this lighting data correctly, all lighting modules 3 must be correctly rotationally oriented. In order to secure a correct orientation, a lighting module 3, when it is in an upstart mode, performs a configuration procedure to be described below.

Firstly an initial situation will be described, i.e. when the lighting system 1 or the array 5 is powered up for the first time or after a power down. As an example, it is assumed that the lighting modules 3 are square, i.e. each lighting module 3 has four sides which can each be interconnected with another lighting module 3. Further, for sake of making the explanation clear the sides are denoted similarly to a compass, i.e. north N, east E, south S, and west W in a clockwise rotational order.

When powering up the lighting system 1, the configuration procedure begins with each lighting module 3, on command of the module controller 10, starting to receive data at all four sides. Then the module controller 10 starts checking the communications units 11 one by one for detecting data reception starting at a predetermined side, such as the north side. The controlling device 7 provides the first lighting module 3 with lighting orientation data and address data. First the handling of the lighting orientation data will be explained, and then it will be explained how the address data is handled. By means of the module controller 10, the first lighting module 3 will detect receiving data at one of its sides, via the communication unit 11, and will analyze the data. The lighting orientation data comprises a reference orientation, for instance "north", which means that the first lighting module receives data from the north side of the neighbor, which in this case is the controlling device 7, but the procedure is the same irrespective of what kind of unit the neighbor is. Since the first lighting module 3 receives data from the north side of the neighbor, it is supposed to receive data on its own south side. Then the module controller 10 of the first lighting module 3 will check if its receiving side is the south side. If so, the first module will perform some predetermined measures including handling the address data. If the receiving side is not the south side, the module controller 10 of the first module is arranged to align its own lighting orientation with the received lighting orientation. The alignment is not obtained by rotating the lighting module 3 physically, but its internal denotation of the different sides will be rotated until the side that is connected with the controlling device 7 becomes the south side. More particularly, in accordance with this embodiment, the first lighting module 3 responds to the non-matching side denotations by permuting all LED driving signals such that the first lighting module, from a viewer's standpoint, seems to rotate itself n×90 degrees in the clockwise direction. Then the lighting module 3 will update the lighting orientation information that it sent to its neighbors.

This alignment will also occur when a lighting module is added to an array of lighting modules already in operation, i.e. up and running, and it may occur, in previous neighbors, when a lighting module 3 is removed from the array 5. Thus, the same start up procedure as when powering up the whole lighting system 1 or the whole array 5 is performed. More particularly, when attaching a lighting module to an array of lighting modules, the newly attached lighting module will, after power-up, start to receive at all 4 sides. More than one side of this new lighting module may face a sending lighting module. As soon as the new lighting module gets power, it will power-up while starting a neighbor lighting module search. Starting from its physical north side, it monitors whether a sending neighbor lighting module is present. The neighboring lighting module detection at a single side is expected to be finished within a frame period of time. If no sending neighbor is found, searching will proceed in a clockwise direction at the east side and so on. As soon as a neighbor is found, the lighting module defines this side as its data input and stops searching.

Further, the configuration procedure has been arranged such that when removing a lighting module 3, those lighting modules 3 lacking input data will automatically initiate a new sending-neighbor search procedure. This approach leads to an interesting observation that a data path will emerge automatically when building the array lighting module by lighting module and that the data path evolving from lighting module to lighting module depends on the order in which lighting modules are being added to the array and their initial orientation. When removing lighting modules from this data path a new alternative path is being formed. This is illustrated in FIG. 2.

Referring to FIG. 2, the first lighting module 15 is succeeded by four more lighting modules 17, 19, 21, 23. Assume that the first lighting module 15 has received the initial lighting orientation data from the controlling device (not shown in FIG. 2). At the second lighting module 17, the sending-neighbor search, initiated within the configuration procedure at power-up, starts searching clockwise from its physical north side. In the present case it will take four searching steps before the second lighting module 17 will find the sending first lighting module 15. Meanwhile, the other lighting modules 19, 21, and 23 will continue searching but will not find a sending neighbor before the second lighting module 17 has found one. In the lighting orientation data now received from the first lighting module 15, there is information telling the second lighting module 17 that it receives data from the east side of the first lighting module 15. The second lighting module 17 checks its own orientation and finds that it has its west side connected with the first lighting module 15, which means that it is aligned with the first lighting module 15.

Then, the second lighting module 17 starts to send data to its north, east, and south sides. The third lighting module 19, the north side of which happen to face the second lighting module 17, will find the second lighting module 17 immediately during its first searching step. This implies that the total time needed for all lighting modules to finish the complete search cycle from lighting module strongly depends on their initial, i.e. arbitrary, orientation. The third lighting module 19 will rotate its orientation to align it with the second module 17, and it will start sending data with updated lighting orientation data. The data path will continue to evolve along a unique path, as shown in FIG. 2*a*.

Figure 2A:
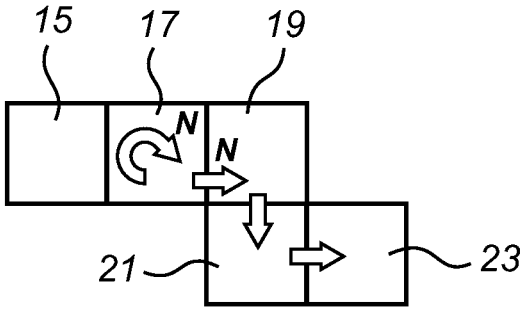
FIGS. 2*a*-2*f* illustrates different examples of how a lighting orientation procedure according to an embodiment of the method works.
Figure 2B:
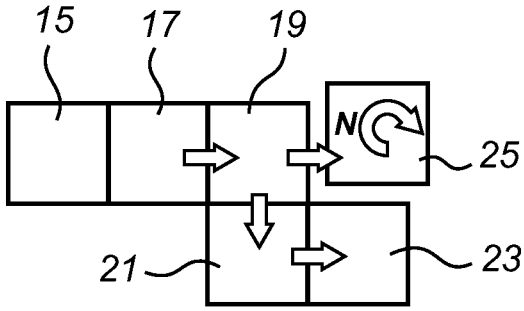
Figure 2C:
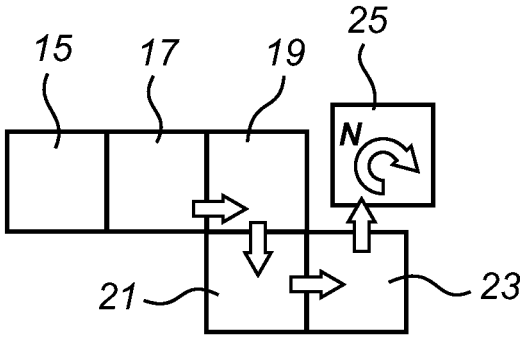

Now assume that the data path running through the first to fifth lighting modules 15, 17, 19, 21, and 23 exists as shown in FIG. 2*a*. When adding a further lighting module 25, such that is has two neighboring lighting modules, namely the third and the fifth lighting modules 19, 23, it may capture data in two ways, as shown in FIGS. 2*b* and 2*c*. Suppose that the north side of the further lighting module 25 is facing the third lighting module 19, and the west side is facing the fifth lighting module 23, see FIG. 2*b*, then it will find the third lighting module 19 immediately and it will stop searching. In the case that the north side of the further lighting module 25 is located at a non-connected side, see FIG. 2*c*, it will select the fifth lighting module 23 to be its signal source, since this will be the first occurring sending lighting module.

Figure 2D:
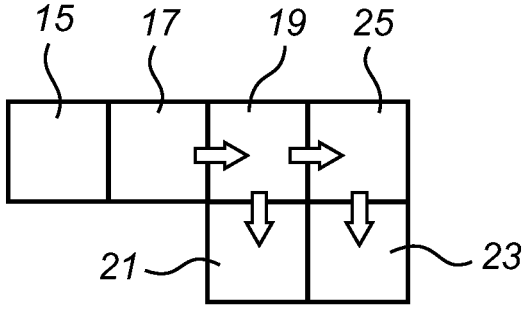
Figure 2E:
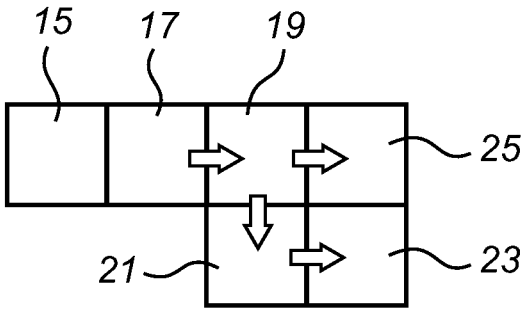
Figure 2F:
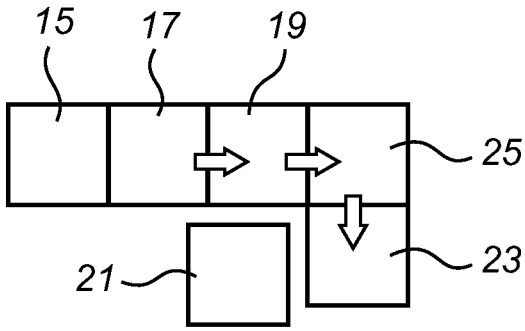

Another situation occurs if no lighting module is being added, but all lighting modules in the array are powered-up simultaneously, see FIGS. 2*d* and 2*e* where there are four lighting modules in a first row and two lighting modules in a second row below the last two lighting modules of the first row. In this case different data paths may emerge depending on the initial rotational orientation of the lighting modules, which determines which lighting module finds a sending neighbor first. The last lighting module, at the lower right corner, will end up receiving data from either the lighting module to the left thereof or from the lighting module above it. In the first case, removal of the lighting module to the left of the last one, see FIG. 2*f*, will force the last lighting module to initiate a new neighbor search in order to let it fetch input data from another lighting module.

When displaying many kinds of lighting patterns the picture content, and thus the lighting data, is usually different for all lighting modules. Consequently, lighting module-specific blocks of lighting data will have to be sent by the controlling device. Assuming that the lighting data is sent in a serial lighting module-by-lighting module format, these blocks of data have to be recognized and captured by the corresponding lighting modules. This requires some method of lighting module addressing i.e. all lighting modules in the array have to be provided with unique addresses at power up, whereas blocks of data have to be sent while labeled with corresponding lighting module addresses. There are various addressing methods conceivable depending on to what extent intelligence, residing in both lighting modules and controlling device, is exploited. As far as the lighting module's intelligence is concerned, (self-) addressing methods largely relies on the lighting module's knowledge of its neighborhood, as is the case with the above-described auto-alignment. The below examples clarify some methods for lighting module addressing, according to the present invention, depending on the specific lighting system configuration.

Assuming that lighting modules are assembled irrespective of their alignment, all below methods are preceded by a configuration procedure as described above. All lighting modules will align themselves towards a unique reference orientation flag, e.g. 'north side', issued by the controlling device with address data sent to the lighting module to which it is connected, and the same side, south side, of all lighting modules will face the entry point of the controlling device.

According to an embodiment of an addressing method, the intelligence of the lighting modules is used to initiate a self-addressing procedure based on communication with neighboring lighting modules. The below example, see FIG. 3, starts from an initiation address provided for by the controlling device 31. At power-up the configuration procedure is started during which lighting modules 33 are searching for sending neighbors while performing auto alignment and developing communication paths running from the controlling device 31 towards all lighting modules 33 in the array, as described above. The address data comprises a column element C and a row element R, and the columns and rows are identified by numbers. Assume that the controlling device 31 is issuing address C2R(−1). This address means that the controlling device 31 acts as a lighting module located at column 2 and row(−1). The lighting module 33 receiving this data at its south side has now sufficient information to know that it is located on top of this sending 'lighting module' with address C2R(−1). In response to this, it will adopt address C2R0, i.e. it will increment the row element, and, in turn, it will send this address to its other three neighbors. For instance, its right neighbor will receive address C2R0 at its west side thereby knowing that it is located at the right side of C2R0, so it will adopt address C3R0, i.e. it will increment its column element.

Figure 3:
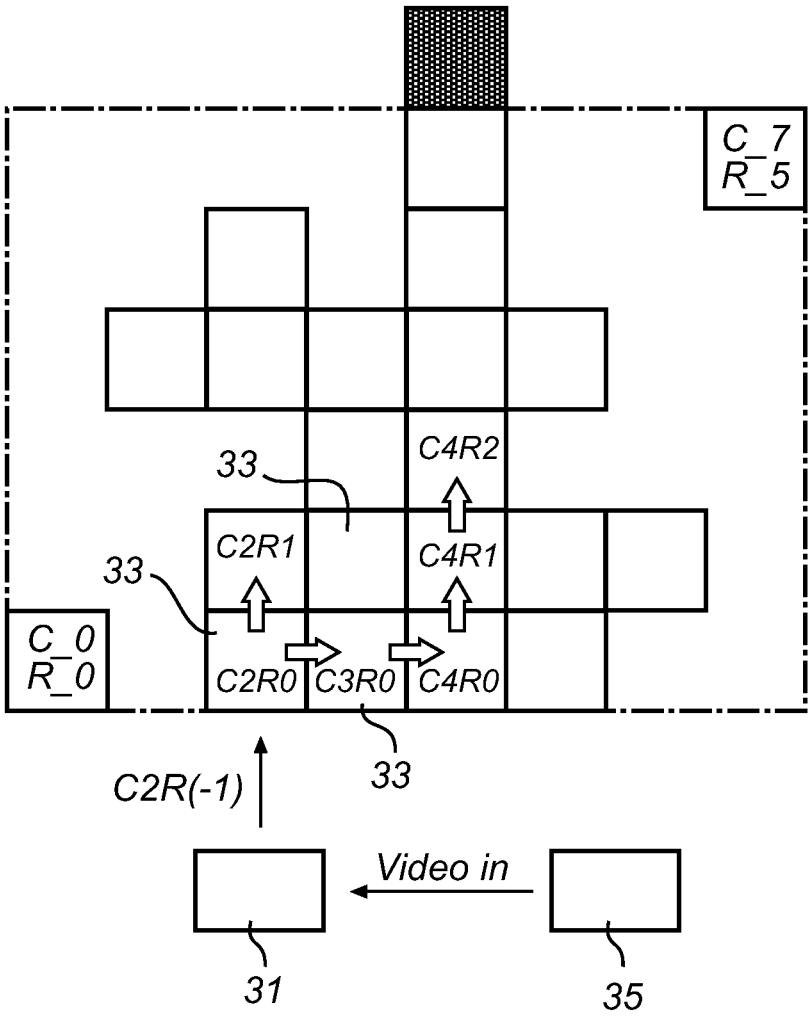
FIG. 3 illustrates an addressing procedure and lighting pattern displaying according to embodiments of the method and system.

Similarly, the lighting module located above the first lighting module will also receive address R2C0, but now at its south side forcing it to adopt address C2R1. This method of relative addressing results in an addressing space as shown in FIG. 3.

Knowing how this procedure of self-addressing develops, the controlling device 31 will prepare a serial message of packages of lighting data and will send them into the lighting module array after having supplied each data package with a corresponding lighting module address.

The present invention provides for simplifying the configuration procedures and the controlling device, and for instance there is no feedback from the lighting modules to the controlling device about positions or addresses. Basically there is no need for the controlling device 31 to know about the size and shape of the array it is driving. However, according to an embodiment of the control method a certain maximal size of the array is predefined, see dashed rectangle in FIG. 3. The controlling device, at reception of external lighting input, such as from a video player or computer 35, generates lighting data confined to the array ranging between C0R0 to C7R5. This means that lighting modules falling beyond this area will not receive picture data and, consequently, these lighting modules will remain dark. This method also implies that unused RGB data is being sent in case lighting module arrays are smaller than the maximum permitted size.

Figure 4:
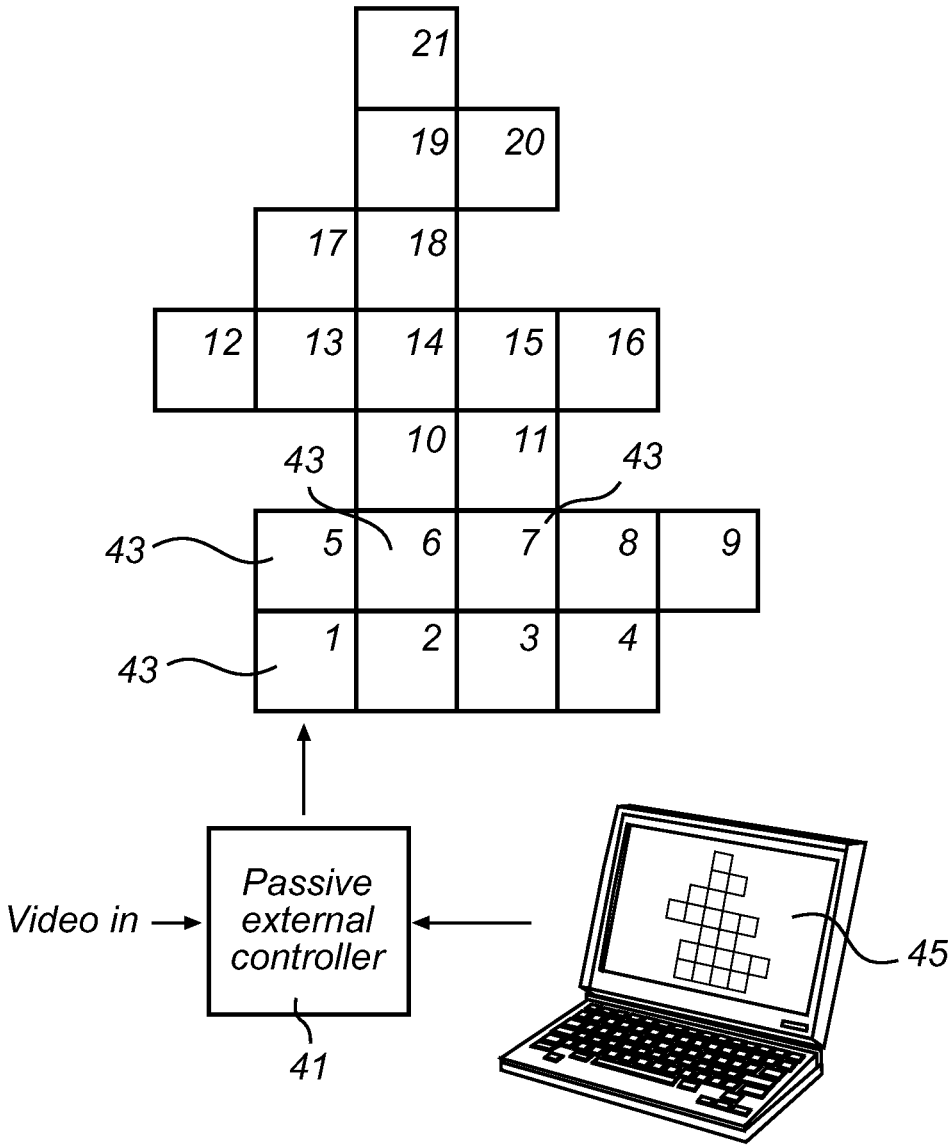
FIG. 4 illustrates an alternative lighting pattern display procedure according to the invention.

According to another embodiment of the method, it is assumed that the controlling device 41 is interfacing a PC 45 running some higher-level design tool enabling the user to configure an array of lighting modules the size and shape of which fits the space to be covered best, see FIG. 4. Such a design tool may also offer the user the possibility to preview lighting patterns under development. As such, the arrangement shown in FIG. 4 can also be used as a means to create special lighting effects dedicated to a particular lighting module configuration. According to this embodiment, the physical lighting module array has to be assembled in accordance with its design counterpart in order to yield the desired lighting effect. This means that the controlling device gets information about the position of every lighting module 43 in the lighting module array it is driving. During the auto-alignment procedure, data paths are created that run from the controlling device towards all lighting modules.

After completion of this configuration procedure at power-up, the controlling device is expected to convey predefined absolute addresses, generated during design, towards the corresponding lighting modules in the array. It is true that the controlling device 41 cannot make use of these already developed data paths since it doesn't know how lighting modules have been rotated during assembling, which is determining how data paths will emerge during power-up, but the resulting addresses are the same anyhow.

An alternative way for the controlling device to reach any lighting module in the array, in order to provide it with an absolute but unique address, is by creation of data broadcasting paths under control of the controlling device 41. This is a feasible approach since the controlling device has full knowledge of the lighting module configuration by design. In contrast to the above method of maximum array size addressing, RGB data is generated only for those lighting modules forming part of the array, so no loss of communication bandwidth will occur.

In accordance with this invention, when the lighting system is up and running the data input by the controlling device to the lighting modules typically comprises control bytes consisting of address data and lighting data bytes tied to each address. Presuming that the lighting modules employ RGB LEDs the lighting data are RGB data for all LEDs on the respective lighting module. However, during the configuration phase, when the controlling device is powered up it once sends the initiation data consisting of the initial orientation and the initial address.

The person skilled in the art realizes that the present invention by no means is limited to the preferred embodiments described above. On the contrary, many modifications and variations are possible within the scope of the appended claims.

The invention claimed is:

1. A method of controlling a lighting system, which lighting system comprises a plurality of polygonal lighting modules arranged as an array, and a controlling device connected to one of the lighting modules, wherein said lighting modules are arbitrarily arrangeable by each lighting module being able to communicate with neighboring lighting modules via communication units arranged at all sides of the lighting module, the method comprising a configuration procedure being performed by each lighting module in an upstart mode, the configuration procedure comprising:

receiving address data and lighting orientation data from a neighboring lighting module, wherein the address data comprises several address elements, which are related to a relative position of the neighboring lighting module within the lighting system;

aligning its own lighting orientation with the lighting orientation of the neighboring lighting module from which it receives address data and lighting orientation data; and determining its own address by one of incrementing and decrementing at least one of the address elements depending on the lighting module's position relative to the neighboring lighting element, and according to a predetermined addressing plan;

wherein a lighting module being connected with the controlling device receives initial address data and lighting orientation data from the controlling device.

2. A method of controlling a lighting system according to claim 1, wherein the configuration procedure is performed for all lighting modules of the lighting system at an initial startup as well as for a single lighting module when it is being added to the lighting system while it is in operation.

3. A method of controlling a lighting system according to claim 1, comprising:

providing the lighting system with lighting data arranged to generate a lighting pattern by means of the lighting modules, wherein the lighting pattern has a predetermined size.

4. A method of controlling a lighting system according to claim 1, wherein the address elements comprise a column element and a row element.

5. A method of controlling a lighting system according to claim 1, wherein the lighting orientation data comprises an individual side identification for each side of a lighting module, the rotational order of side identifications being the same for all lighting modules, wherein said step of aligning comprises setting the lighting orientation according to a unique predetermined combination of side identifications.

6. A method of controlling a lighting system according to claim 1, further comprising sending, from each lighting module, said address data and lighting orientation data to neighboring lighting modules, except for the one from which it is receiving data.

7. A method of controlling a lighting system according to claim 6, wherein said aligning is followed by updating the lighting orientation data to be sent to said neighboring lighting modules after having changed its lighting orientation.

8. A lighting system comprising a plurality of polygonal lighting modules, and a controlling device, which are interconnectable and which are able to communicate with each other, wherein said lighting modules are arbitrarily arrangeable by each lighting module being able to communicate with neighboring lighting modules via communication units arranged at all sides of the lighting module, characterized in that each lighting module comprises a module controller, which is arranged to, in a startup mode, receive address data and lighting orientation data via one of the communication units from a neighboring lighting module, wherein the address data comprises several address elements (R, C), which are related to a relative position of the neighboring lighting module within the lighting system, to align its own lighting orientation with the lighting orientation of the neighboring lighting module, and to set its own address by performing one of incrementing and decrementing at least one of the address elements depending on the lighting module's position relative to the neighboring lighting element, and a predetermined addressing plan.

* * * * *